US008824721B2

(12) United States Patent
Zapalac

(10) Patent No.: US 8,824,721 B2
(45) Date of Patent: Sep. 2, 2014

(54) SOUND SPORTS BOARD APPARATUS AND A METHOD OF MAKING THE SAME

(76) Inventor: Jeremy A. Zapalac, Richmond, TX (US)

( * ) Notice: Subject to any disclaimer, the term of this patent is extended or adjusted under 35 U.S.C. 154(b) by 214 days.

(21) Appl. No.: 13/191,047

(22) Filed: Jul. 26, 2011

(65) Prior Publication Data

US 2012/0027223 A1 Feb. 2, 2012

Related U.S. Application Data

(60) Provisional application No. 61/369,882, filed on Aug. 2, 2010.

(51) Int. Cl.
*H04R 1/02* (2006.01)

(52) U.S. Cl.
CPC ..... *H04R 1/028* (2013.01)
USPC ..... 381/389; 381/386; 381/86

(58) Field of Classification Search
CPC ..... H04R 1/02
USPC ..... 381/124, 384, 389, 386, 86
See application file for complete search history.

(56) References Cited

U.S. PATENT DOCUMENTS

| | | | | |
|---|---|---|---|---|
| 4,824,139 | A | 4/1989 | Robbins | |
| 5,570,322 | A * | 10/1996 | Miller | 367/107 |
| 6,837,182 | B2 | 1/2005 | Leblanc | |
| 6,880,288 | B1 * | 4/2005 | Hanes | 43/44.87 |
| 7,089,876 | B2 | 8/2006 | Porat | |
| 7,263,032 | B2 | 8/2007 | Polany et al. | |
| 7,302,905 | B1 | 12/2007 | Wynne | |
| 8,270,659 | B2 * | 9/2012 | Koizumi et al. | 381/386 |
| 2006/0008104 | A1 | 1/2006 | Sausser | |
| 2006/0050903 | A1 * | 3/2006 | Chan | 381/124 |
| 2007/0054573 | A1 * | 3/2007 | Skedeleski | 441/65 |
| 2008/0080734 | A1 * | 4/2008 | Forth et al. | 381/386 |
| 2010/0263603 | A1 * | 10/2010 | Baron | 119/850 |

OTHER PUBLICATIONS

"Aeropak Fuel Cell Propulsion System for Unmanned Aerial Vehicles," Horizon Energy Systems, www.hes.sg, available online on Jul. 2, 2010, 1 page.
"H-Series PEM Fuel Cell Systems," Horizon Fuel Cell Technologies, www.horizonfuelcell.com, available online on Jul. 2, 2010, 1 page.
"iV6—Waterproof Case for the iPod Classic (6th Gen)," H2O Audio, www.h2oaudio.com, available online on Jun. 30, 2010, 1 page.

(Continued)

*Primary Examiner* — Disler Paul
(74) *Attorney, Agent, or Firm* — Locke Lord LLP

(57) ABSTRACT

A sports board apparatus and method including a first speaker housing adapted to receive a first speaker and an audio device housing adapted to receive an audio device. The first speaker housing can be adapted to mount the first speaker substantially flush with the top surface of the sports board. The audio device housing can be adapted to mount an audio device substantially flush with the top surface of the sports board. An electrical conduit can be operably coupled to the first speaker housing and adapted to be coupled to the audio device so that a sports board owner can listen to music or other audio programming while engaging in leisurely activities, such as surfing, snowboarding, kayaking, wakeboarding, windsurfing, or skateboarding. The sports board can also include a stabilizing fin, a power supply, a solar collection device, an amplifying device, and a second speaker for deterring aquatic creatures.

20 Claims, 5 Drawing Sheets

(56) References Cited

OTHER PUBLICATIONS

"JL Audio M100-CT," Crutchfield Signature, www.signature.crutchfield.com, available online on May 12, 2010, 3 pages.

Miller, Steven, "Surfboard Shaping and Glassing," Copyright 2006 by Lulu.com, 2 pages.

"US Blanks [Various Superfused and A-Sup Board Designs]", US Blanks, www.USBlanks.com, available online on Apr. 20, 2010, 7 pages.

* cited by examiner

SOUND SPORTS BOARD APPARATUS AND A METHOD OF MAKING THE SAME

CROSS REFERENCE TO RELATED APPLICATIONS

This application claims the benefit of U.S. Provisional Patent Application No. 61/369,882, filed Aug. 2, 2010, titled "Sound Sports Board Apparatus and a Method of Making the Same" and incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention disclosed and taught herein relates generally to sports boards for both aquatic and non-aquatic related activities. More specifically, the invention relates to incorporating an audio system into various types of sports boards.

2. Description of the Related Art

Sports boards are available in various shapes and sizes. For example, some sports boards are smaller, single-person transport carriers, such as surfboards, wakeboards, or snowboards. Other sports boards are designed as multi-person transport carriers, such as kayaks or canoes. Although sports boards can be employed as a means of conveyance, typically individuals utilize these boards merely to engage in leisurely or sporting activities, such as snowboarding, surfing, or kayaking. While engaging in these activities, individuals sometimes express a desire to listen to music or other audio programming. It is a commonly held belief that music can positively affect an individual's performance while engaging in these leisurely activities. Accordingly, prior art solutions exist providing individuals with the opportunity to listen to music or other audio programming while engaging in these activities.

Commonly, individuals utilize portable audio devices in conjunction with a set of headphones to listen to music while engaging in these sporting activities. Although this solution provides individuals with a means to listen to music while participating in sporting activities, if has several drawbacks. First, portable audio devices are often too bulky to attach to the individual. By way of example, surfers typically wear wetsuits while surfing, and it is often difficult to mount or store these portable audio devices within, on, or around the wetsuit while participating in this particular sport. Second, some of the previously discussed activities can be dangerous, and thus in order to avoid injury, individuals must posses sufficient awareness of the ambient noises of is their environment. Again, using surfing as an example, surfers often rely on their ears to gauge the surf, wind, and the breakers to react appropriately to this volatile environment. Often headphones can distract individuals from these ambient noises, thus increasing the potential for injury.

Alternatively, individuals can utilize a portable audio device in conjunction with a portable external speaker. This solution allows individuals to engage in these activities while enjoying music and other audio programming without dampening one's awareness of the ambient noise of the environment. However, this solution has several drawbacks as well. For example, external speakers are often bulker than their associated portable audio devices, and thus they are difficult or impractical to attach to the individual. Furthermore, these external speakers often do not have the capacity to amplify the sound to appropriate decibel levels while individuals engage in these activities.

It is therefore desirable for individuals to have a better solution for listening to music and other audio programming while engaging in these sporting activities in order to overcome the problems set forth above.

BRIEF SUMMARY OF THE INVENTION

The present invention is directed to incorporating an audio system into various types of sports board apparatuses. A sports board apparatus can include a water board apparatus, such as surfboards, windsurfing boards, stand-up paddle boards, wakeboards, kneeboards, snowboards, kayaks, or canoes. Further, a sports board apparatus can include a non-water board apparatus, such as skateboards.

The disclosure provides a water board apparatus including a water board adapted to traverse the surface of water, snow, or ice. The water board can include a first speaker housing adapted to receive and mount a first speaker, and an audio device housing adapted to receive an audio device. The first speaker housing can be is adapted to mount the first speaker substantially flush with a top surface of the water board. The audio device housing can be adapted to mount the audio device substantially flush with the top surface of the water board. The first speaker housing can be either a single housing adapted to receive a first speaker, or at least two sub-speaker housings, each adapted to receive a sub-speaker.

The disclosure also provides an audio device housing that can include an audio device housing lid adapted to be coupled to a portion of the audio housing. The audio device housing lid can form a water-resistant seal with the audio device housing when the audio device housing lid is coupled to the audio device housing in a manner that is substantially flush with the top surface of the water board. The water board can include a stabilizing fin coupled to the bottom surface of the water board.

The disclosure also can include a first electrical conduit operably coupled to the first speaker, and adapted to be coupled to the audio device. The water board can include a housing box adapted to mount a power supply, an amplifying device, or both. The power supply can be a battery or a fuel cell. The housing box can include a housing box lid adapted to be coupled to a portion of the housing box. The housing box lid can form a water-resistant seal with the housing box when the housing box lid is coupled to the housing box in a manner that is substantially flush with the top surface of the water board. The housing box lid can include an access area so that an individual rider can access an on/off switch used in connection with the power supply, the amplifying device, or both, when the housing box lid is coupled to the housing box.

The disclosure can include a solar collection device housing adapted to receive and mount a solar collection device substantially flush with a bottom surface of the water board. The water board can include a second speaker housing that can receive and mount a second speaker substantially flush with the bottom surface of the water board.

The disclosure also provides a method of forming a water board apparatus including forming a water board having a top surface and a bottom surface and adapted to traverse the surface of water, snow, or ice. Forming the water board can is include forming a first speaker housing adapted to receive and mount a first speaker, and forming an audio device housing adapted to receive an audio device. The first speaker housing can be adapted to mount the first speaker substantially flush with the top surface of the water board. The audio device housing can be adapted to mount the audio device substantially flush with the top surface of the water board.

The disclosure also provides a first electrical conduit operably coupled to the first speaker, and adapted to be coupled to the audio device. The method can include forming a housing box adapted to mount a power supply, an amplifying device, or both.

The disclosure can also include forming a solar collection device housing that can be adapted to receive and mount a solar collection device substantially flush with the bottom surface of the water board. The method can include forming a second speaker housing that can receive and mount a second speaker substantially flush with the bottom surface of the water board. The method can also include coupling a stabilizing fin to the bottom of the water board. The method can also include mounting the second speaker, the solar collection device, the power supply, and the amplifying device substantially flush with one or more surfaces of the water board. Furthermore, the method can include forming the first speaker housing by forming at least two sub-speaker housings, where each sub-speaker housing can be adapted to mount at least one sub-speaker substantially flush with the top surface of the water board.

BRIEF DESCRIPTION OF THE SEVERAL VIEWS OF THE DRAWINGS

The following Figures form part of the present specification and are included to further demonstrate certain aspects of the present invention. The invention may be better understood by reference to one or more of these Figures in combination with the detailed description of specific embodiments presented herein.

Figure 1:
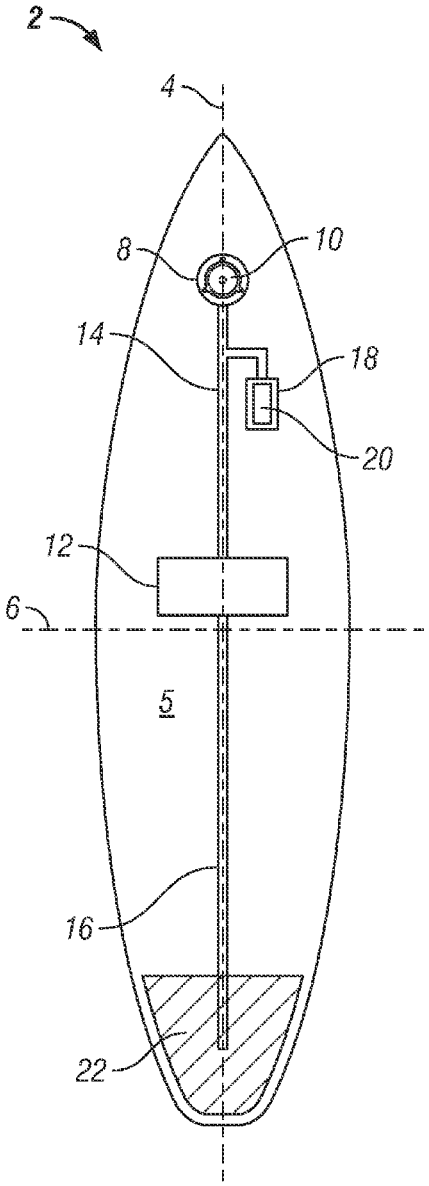
FIG. 1 is a top schematic view of a first embodiment of the sports board apparatus.

While the invention disclosed herein is susceptible to various modifications and alternative forms, only a few specific embodiments have been shown by way of example in the drawings and are described in detail below. The Figures and detailed descriptions of these specific embodiments are not intended to limit the breadth or scope of the inventive concepts or the appended claims in any manner. Rather, the Figures and detailed written descriptions are provided to illustrate the inventive concepts to a person of ordinary skill in the art and to enable such person to make and use the inventive concepts.

DETAILED DESCRIPTION

The disclosure provides a sports board apparatus and method of making the same including a first speaker housing adapted to receive a first speaker and an audio device housing adapted to receive an audio device. The first speaker housing can be adapted to mount the first speaker substantially flush with the top surface of the sports board. The audio device housing can be adapted to mount an audio device substantially flush with the top surface of the sports board. An electrical conduit can be operably coupled to the first speaker housing and adapted to be coupled to the is audio device so that a sports board owner can listen to music or other audio programming while engaging in leisurely activities, such as surfing, snowboarding, kayaking, wakeboarding, windsurfing, or skateboarding. The sports board apparatus can also include a stabilizing fin, a power supply, a solar collection device, an amplifying device, an on/off switch, and a second speaker for deterring aquatic creatures.

Figure 2:
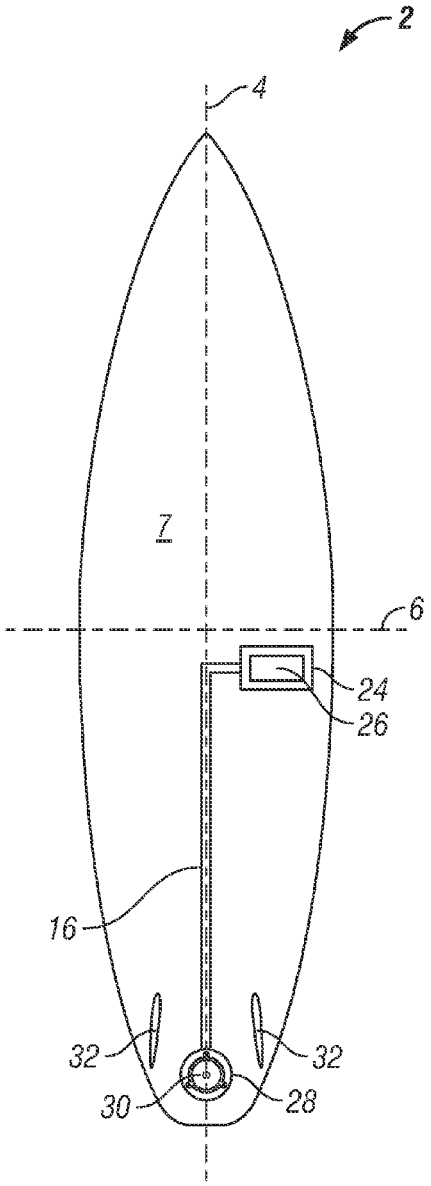
FIG. 2 is a bottom schematic view of a first embodiment of the sports board is apparatus depicted in FIG. 1.

FIG. 1 is a top schematic view of a first embodiment of the sports board apparatus. The water board apparatus can include a water board 2 with a top surface 5 and a bottom surface 7 as shown in FIG. 2 having a longitudinal axis 4 and a lateral axis 6. The water board 2 can include a first speaker housing 8 adapted to mount a first speaker 10. In one embodiment, the first speaker can be mounted such that it is substantially flush with the top surface 5 of the water board 2. Although FIG. 1 depicts the first speaker 10 as a single speaker, the first speaker 10 can include a speaker set that can be defined as one or more sub-speakers. For example, FIG. 7, as discussed in greater detail below, illustrates a first speaker depicted as a first speaker set that can include two individual sub-speakers as elements 48 and 50.

The water board 2 can also include a housing box 12 adapted to mount various components in a manner substantially flush with the top surface 5 of the water board 2. Further details of the housing box 12 and associated components will be described in more detail below in FIG. 3.

Furthermore, water board 2 can include an audio device housing 18 adapted to receive and mount an audio device 20 substantially flush with the top surface 5 of the water board 2. The water board 2 can also include a first electrical conduit 14 that is operably coupled to the first speaker 10 and further adapted to be coupled to the audio device 20.

In one embodiment, the first electrical conduit 14 extends from the first speaker housing 8 to the audio device housing 18, and further extends to the housing box 12. By extending this conduit, the first electrical conduit 14 is adapted to operably couple the first speaker 10, the audio device 20, and the components mounted in the housing box 12. Although FIG. 1 depicts the first electrical conduit 14 as terminating at the housing box 12, the first speaker housing 8, and the audio device housing 18, in one embodiment, the first electrical conduit 14 can extend to any portion on the water board 2, as appropriate.

Water board 2 can also include a second electrical conduit 16 to operably couple components mounted in the housing box 12, with other electrical components mounted in the water board 2. In one embodiment, the second electrical conduit 16 extends from the housing box 12 in the direction of the longitudinal axis 4 towards the traction pad 22. Although FIG. 1 depicts the second electrical conduit 16 as extending under a particular portion of the water board 2 below the lateral axis 6, the second conduit 16 can extend from the housing box 12 to any portion on the water board 2, as appropriate.

Although the first electrical conduit 14 and second electrical conduit 16 are depicted in FIG. 1 as elements that can be seen from a top perspective of the water board 2, these conduits can be fully integrated into the water board 2. The definition of fully integrated is discussed further below in conjunction with FIGS. 5 and 6. In at least one embodiment, the conduits can be fully integrated into the water board 2 at least one-quarter inch below the top surface 5 of the water board 2, at least one-quarter inch above the bottom surface 7 of the water board 2, or both. These electrical conduits can include any carrier means for electronically, magnetically, or optically coupling two or more components. For example, the conduits could include wires, fiber optics, cables, or other material or medium adapted to carry electrical, optical, magnetic, or telecommunication signals. In an exemplary, non-limiting illustrative embodiment, the conduits can include speaker wire.

The water board 2 can also include a traction pad 22. In one embodiment, the traction pad 22 can be coupled to the top surface 5 of the water board 2. In at least one embodiment, the traction pad 22 can provide individuals with better traction while riding on the water board 2.

FIG. 2 is a bottom schematic view of a first embodiment of the sports board apparatus depicted in FIG. 1. This Figure depicts a water board 2 having a longitudinal axis 4, a lateral axis 6, a top surface 5 as shown in FIG. 1, and a bottom surface 7. In one embodiment, the water board 2 can include a stabilizing fin 32 adapted to be coupled to the water board 2. The stabilizing fin 32 can be particularly useful while engaging in aquatic or littoral sporting activities, such as surfing, because the stabilizing fin 32 can provide additional stability to the water board 2 while individuals traverse the surface of water. The stabilizing fin 32 can be made out of a light weight material, such as carbon fiber or any other material suitable for constructing a component for adding additionally stability to the water board 2. In one embodiment, at least two stabilizing fins 32 can be coupled to the bottom surface 7 of the water board 2.

The water board 2 can include a first solar collection device housing 24 adapted to mount a solar collection device 26 to the water board 2. In at least one embodiment, the solar collection device can be mounted substantially flush with the bottom surface 7 of the water board 2. The solar collection device 26 can be adapted to be coupled with a power supply 34, as discussed more specifically in FIG. 3.

In one embodiment, the solar collection device 26 can be coupled to the power supply 34 through electrical coupling, such as employing alligator clips, soldering, or both. By mounting the solar collection device 26 on the bottom surface 7 of the water board 2, an individual rider can rest the water board 2 on all or a portion of its top surface 5 while not in use. By doing so, the solar collection device 26 can collect the sun's photons to generate energy that can be later consumed by the other components mounted in or on the water board 2. For example, the solar collection device 26 can be used to recharge the power supply 34, or power other components of the water board 2 without the need of the power supply 34. The solar collection device 26 can include solar panels, solar cells, photovoltaic cells, photovoltaic panels, photovoltaic modules, photovoltaic arrays, or any combination thereof.

The water board 2 can also include a second speaker housing 28 adapted to mount a second speaker 30 substantially flush with the bottom surface 7 of the water board 2. In one embodiment, the second speaker 30 can include a speaker set that can be defined as one or more sub-speakers. Water board 2 can also include the second electrical conduit 16 that is adapted to be operably coupled to various components including one or more of the following: components mounted in the housing box 12 as discussed in greater detail below in FIG. 3, the solar collection device 26, or the second speaker 30.

The second speaker 30 can be used to output an audio signal adapted to output low frequency audio waves (typically in the range of 30-500 Hz) in order to deter dangerous animals, such as sharks or other aquatic or non-aquatic creatures. The output of the second speaker 30 can be driven independently of the first speaker 10 such that an individual rider can simultaneously listen to music while broadcasting the low frequency deterring waves. Because the second speaker 30 can be adapted to be mounted substantially flush with the bottom surface 7 of the water board 2, the deterring sound waves can be directed radially outward towards the surrounding environment. For example, if the water board 2 is used in water, the second speaker 30 can transmit audio waves into the surrounding body of water.

The first speaker 10 and second speaker 30 can include various types of speakers, including tweeters, mid-range, woofers, sub-woofers, or any combination thereof. In one embodiment, the first speaker 10 can be a first speaker set including marine grade water-resistant tweeters. Both the first speaker 10 and the second speaker 30 can be water-resistant speakers, or non-water-resistant speakers coated with, encased within, or surrounded by, a water-resistant material.

Although the first electrical conduit 14 and second electrical conduit 16 are depicted in FIG. 1 as components that can be seen from a bottom perspective of the water board 2, these conduits can be fully integrated into the water board 2, as discussed further below in conjunction with FIGS. 5 and 6.

Figure 3:
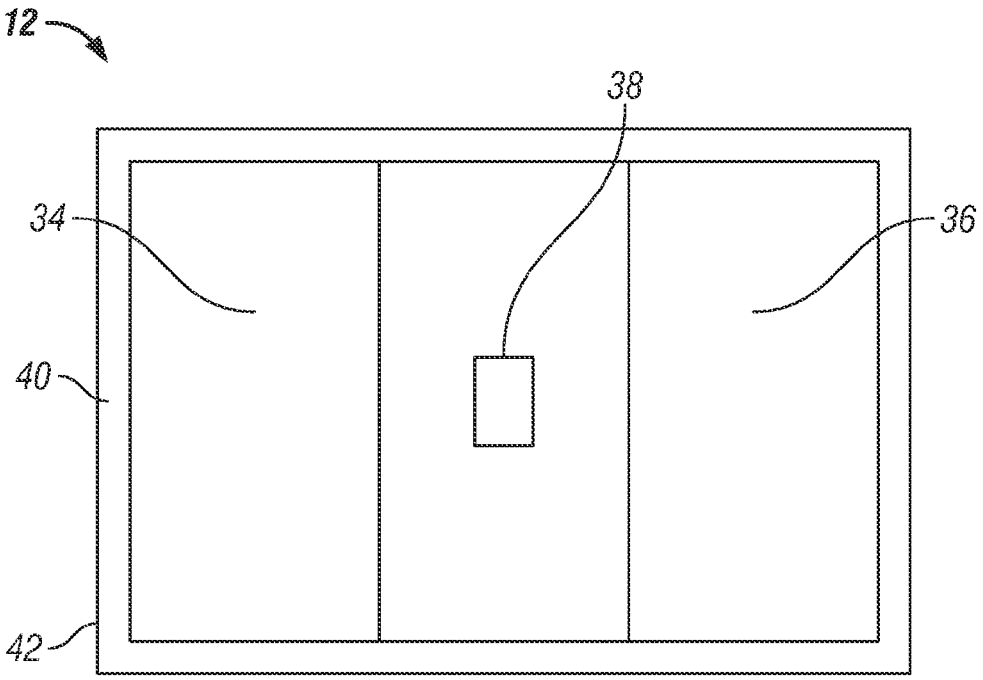
FIG. 3 is a detail schematic view of the housing box depicted in FIG. 1.

FIG. 3 is a detail schematic view of the housing box 12 depicted in FIG. 1. The housing box 12 can include a power supply 34, an amplifying device 36, or both. The housing box 12 can include a component for mounting the power supply 34 and amplifying device 36 in separate sub-compartments. The housing box 12 can further include an on/off switch 38 for controlling the power of the power supply 34, the amplifying device 36, or both. In one embodiment, the power supply 34 can be a DC power supply, such as a battery. The power supply can also include an AC power supply, or a power supply that can be either AC or DC, such as a fuel cell. In one embodiment, the power supply 34 and the amplifying device 36 can each be mounted in a respective water-resistant casing, or they can be mounted in the same water-resistant casing.

The housing box 12 can be adapted to receive a housing box lid 42 for covering the housing box 12. Once adapted to the housing box 12, the housing box lid 42 can be mounted substantially flush with the top surface 5 of the water board 2, shown in FIG. 1. The housing box 12 can further include a water-resistant seal 40. Although FIG. 3 depicts the water-resistant seal 40 as a mechanical seal, such as a gasket, other water-resistant sealants can be employed as well. For example, water-resistant seal 40 can be any liquid, solid, gas, or other material that can be employed to resist water entering into the housing box 12, such as sealants, gaskets, or O-rings. Once the housing box lid 42 is mounted on the housing box 12, the water-resistant seal 40 can resist water seeping into the interface between the housing box lid 42 and the housing box 12. This configuration forms a water-resistant seal that can prevent a substantial amount of water or moisture from passing through or around a water-resistant seal. In one embodiment, anchors (not shown in the Figures) can be applied to the water board 2 to assist in coupling the housing box lid 42 to the housing box 12. In one embodiment, fasteners, such as screws, can be used in conjunction with the anchors to secure the housing box lid 42.

Figure 4:
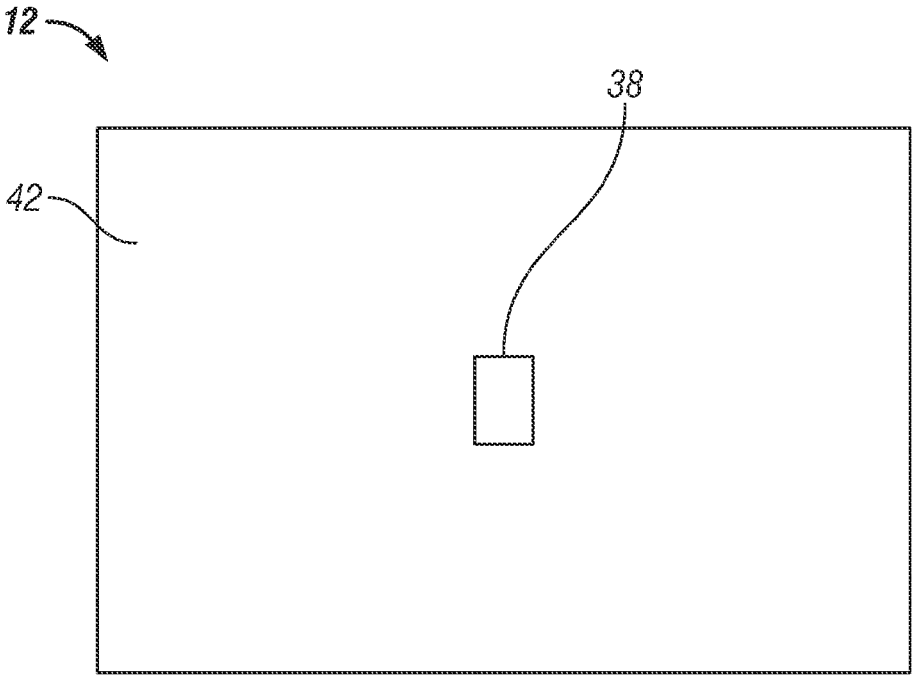
FIG. 4 is another detail schematic view of the housing box depicted in FIG. 1.

FIG. 4 is another detail schematic view of the housing box 12 depicted in FIG. 1. In one embodiment, the housing box lid 42 can cover the various components mounted in the housing box 12 except for the on/off switch 38. In this embodiment, the on/off switch 38 can protrude through the housing box lid 42 above the top surface 5 of the water board 2 shown in FIG. 1, thus allowing an individual to access the on/off switch 38 even with the housing box lid 42 mounted to the housing box 12. In another embodiment, the on/off switch 38 does not protrude through the housing box lid 42; however, a rider can access the on/off switch 38 through an opening in the housing box lid 42. By doing so, an individual can turn components on or off, even if they are mounted in the housing box 12 under the housing box lid 42 while still actively engaging the sports-related activity. For example, if an individual uses the water board to surf, the individual can toggle the on/off switch 38 while waiting for the next wave to arrive without the need of removing the housing box lid 42. As a further alternative, the housing box lid 42 can be formed from a flexible material or formed partially from such material to allow flexing of the housing box lid 42 for operative access to the switch 38. In one embodiment, the on/off switch 38 can be a marine-grade, boat toggle switch covered in a water-resistant material, such as a rubber boot. In another embodiment, the housing box lid 42 can be formed such that an individual cannot access the on/off switch 38 without first removing the housing box lid 42.

Figure 5:
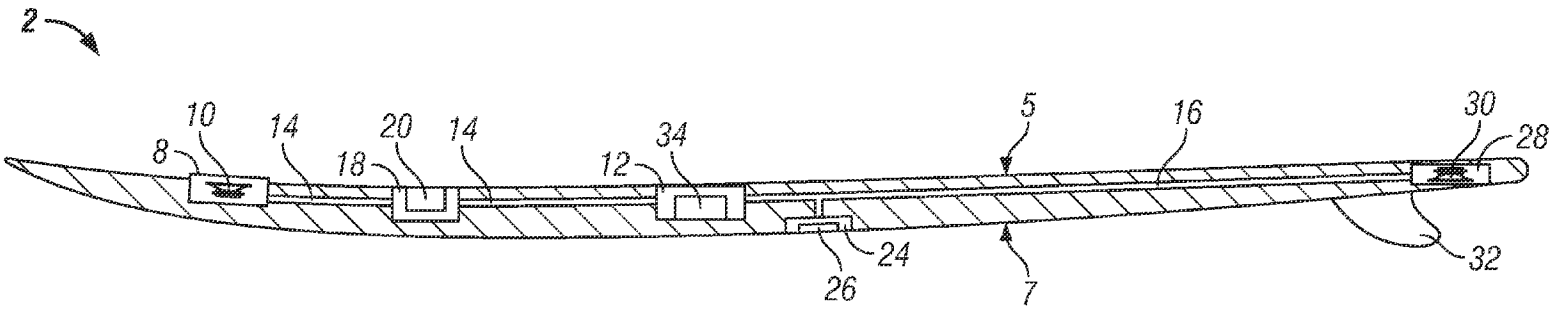
FIG. 5 is a cross-sectional schematic view of a first embodiment of the sports board apparatus depicted in FIG. 1.
Figure 6:
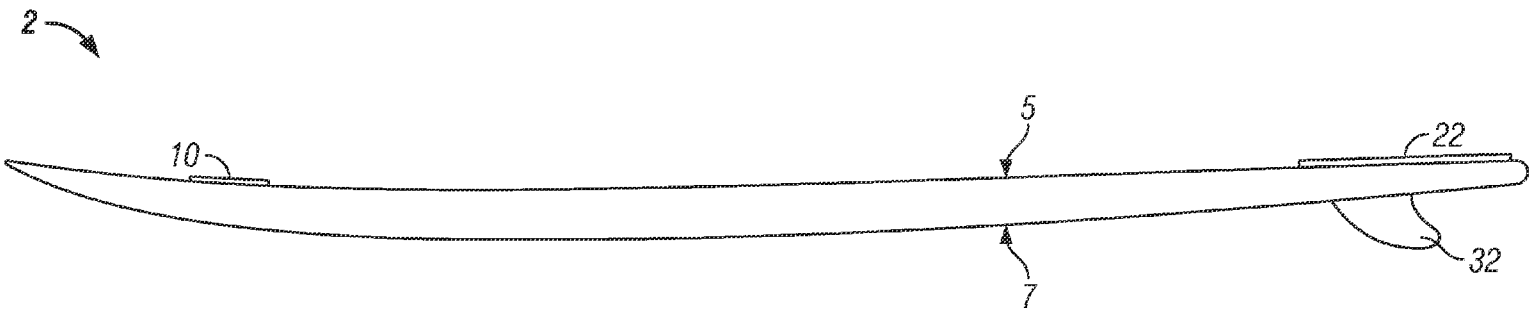
FIG. 6 is a side schematic view of a first embodiment of the sports board apparatus depicted in FIG. 1.

FIG. 5 is a cross-sectional schematic view of a first embodiment of the sports board apparatus depicted in FIG. 1. FIG. 6 is a side schematic view of a first embodiment of the sports board apparatus depicted in FIG. 1. These Figures further illustrate the configuration of the components, depicted as elements in FIGS. 1 and 2 above. According to FIG. 5, the first speaker housing 8 can mount a first speaker 10 substantially flush with the top surface 5 of the water board 2. The term "substantially flush" can be defined as the position of a component arranged such that more of the volume of the component lies below a surface of the water board 2 than above, that is, more of the component lies below the top surface 5 of the water board 2 than above, or above the bottom surface 7 of the water board 2 than below. Further, the term "fully flush" can be defined as the position of a component having a terminating edge or surface that lies in the same plane as a surface of the water board 2.

The term "partially flush" can be defined as the position of a component where only a small percentage of the volume of the component lies above the top surface 5 of the water board 2, or below the bottom surface 7 of the water board 2. A small percentage, for example, can include approximately 1-10% of the volume of the component. The term "substantially flush" can include the terms "fully flush" and "partially flush." The remaining components depicted in FIG. 5, for example, the audio device 20 in the audio housing 18, the power supply 34, the amplifying device 36 of FIG. 3, and the on/off switch 38 of FIG. 3 in the housing box 12, the solar collection device 26 in the solar collection device housing 24, and the second speaker 30 in the second speaker housing 28, can also be mounted substantially flush with the water board 2.

The water board 2 can include components mounted substantially flush with the top surface 5, or bottom surface 7, or both surfaces of water board 2, as described above. Accordingly, this configuration can improve the laminar flow of the water board 2 when it traverses a medium. For example, when the water board 2 is employed as a surfboard, water flows over the bottom surface 7 of the water board 2, creating drag. When surfing, ideally water does not flow over the top surface 5 of the water board 2; however, this ideal is typically not the case. Invariably, some water flows over the top surface 5 as well, thus creating additional drag. This additional drag, in turn, can adversely affect the performance of the water board 2. The more surface area exposed by the mounted components, the greater the drag. Additionally, irregular surfaces exposed above the top surface 5 of the water board 2, or below the bottom surface 7 of the water board 2, can increase the forces and stress on the water board 2. Accordingly, it is desirable to mount the components substantially flush with the top surface 5 and the bottom surface 7 of the water board 2 in order to improve the performance of water board 2. To further minimize drag, the water board 2 can employ a double concave bottom.

The first electrical conduit 14 and second electrical conduit 16 can be fully integrated into the water board 2. The term "fully integrated" can be defined as the is position of a component that is mounted into the water board 2, such that no portion of the component resides above the top surface 5 of the water board 2, or below the bottom surface 7 of the water board 2. Alternatively, these conduits can be mounted such that the first electrical conduit 14 and second electrical conduit 16, or both, are substantially flush with one or more surfaces of the water board 2.

Figure 7:
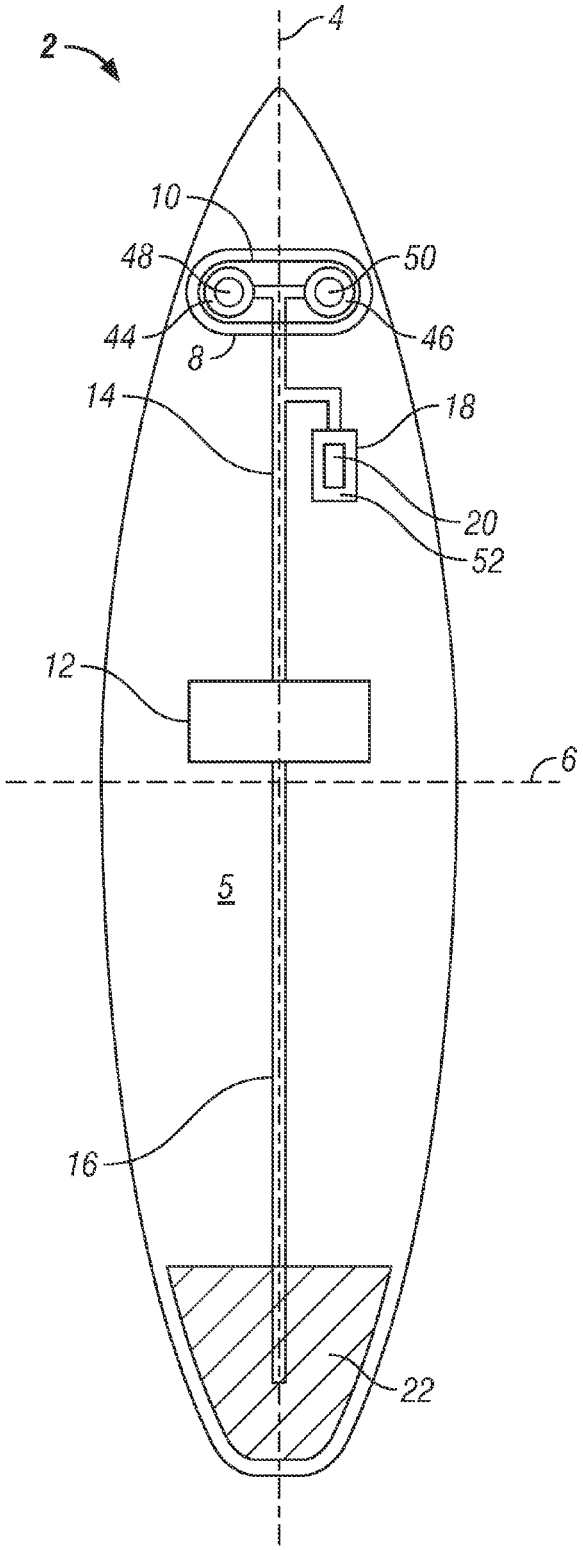
FIG. 7 is a top schematic view of a second embodiment of the sports board apparatus.

FIG. 7 is a top schematic view of another embodiment of the sports board apparatus. The embodiment disclosed in FIG. 7 is similar to the one illustrated in FIG. 1; however in FIG. 7, the first speaker housing 8 of FIG. 1 can include a first sub-speaker housing 44 and a second sub-speaker housing 46. The first sub-speaker housing 44 can be adapted to mount a first sub-speaker 48 substantially flush with the top surface 5 of the water board 2, and the second sub-speaker housing 46 can be adapted to mount a second sub-speaker 50 substantially flush with the bottom surface 7 of the water board 2. The two sub-speakers 48 and 50 can be employed to define a variety of speaker systems, such as a stereo speaker system, or a dual-mono speaker system. In other embodiments, the first speaker housing 8 can include three or more sub-speaker housings, each adapted to mount a respective sub-speaker substantially flush with the top surface 5 of the water board 2.

The audio device housing 18 can include an audio device housing lid 52. The audio device housing lid 52 can be adapted to be coupled to a portion of the audio device housing 18. The audio device housing lid 52 can form a water-resistant seal with the audio device housing 18. The audio device housing lid 52 can be coupled to the audio device housing 18 in a manner that is substantially flush with the top surface 5 of the water board 2. The audio device housing lid 52 can include any protective material suitable for covering a substantial portion of the audio device housing 18. In one embodiment, the audio device housing lid 52 can be formed from a flexible material or formed partially from such material to allow flexing of the audio device housing lid 52 for operative access to an audio device 20. Accordingly, an individual can manipulate an audio device 20 while the audio device housing lid 52 is coupled to the audio device housing 18. For example, a flexible membrane can be employed to is operate an mp3 player with touch screen controls while the audio device housing lid 52 is coupled with the audio device housing 18.

Alternatively, the audio device 20 can be mounted within a water-resistant component, such as a water-resistant casing for the audio device 20. The audio device 20 can also be mounted in the audio device housing 18 with the aid of a mounting substance, such as an adhesive, a clamp, or any other material suitable for mounting an audio device 20 within an audio device housing 18. For example, the mounting substance can include Velcro® material to secure the audio device 20 to the audio device housing 18.

By coupling the audio device 20 to the first electrical conduit 14, an individual can listen to music through the first speaker 10, shown in FIG. 1, or the sub-speakers 48 and 50, shown in FIG. 7. By further employing the components mounted in the housing box 12 (for example, the power supply 34 of FIG. 3, the amplifying device 36 of FIG. 3, or both), the individual rider can amplify music or other audio programming while participating in sports-related activities with the water board 2. For example, the amplifying device 36 of FIG. 3 can include a general commercially available audio amplifier used to increase the amplitude of an audio signal. The power supply 34 of FIG. 3 can be employed to supply the necessary power to the amplifying device 36 of FIG. 3, the audio device 20, or both. By adjusting the amplification, an individual can vary the decibel level output of speakers 10 and 30 according to the individual's particular needs.

Figure 8:
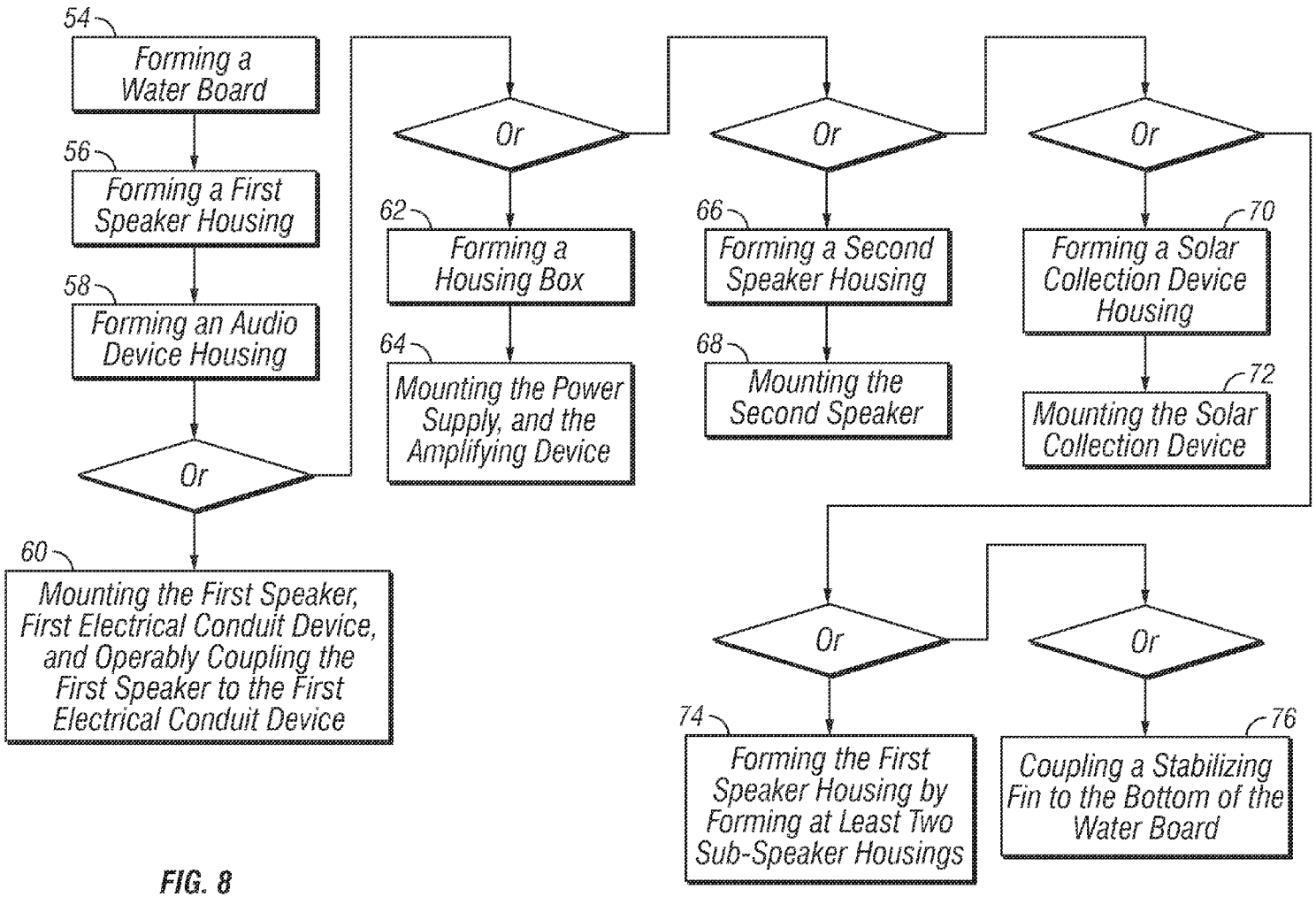
FIG. 8 is a flow diagram depicting an exemplary method of forming a sports board apparatus.

FIG. 8 is a flow diagram depicting an exemplary method of forming a sports board apparatus. The method can include a process for making a water board apparatus, including the step 54 of forming a water board adapted to traverse the surface of water, snow, or ice. The step 54 of forming the water board can include the step 56 of forming a first speaker housing adapted to receive and mount a first speaker, and the step 58 of forming an audio device housing adapted to receive an audio device. The first speaker housing can be adapted to mount the first speaker substantially flush with the top surface of the water board. The audio device housing is can be adapted to mount the audio device substantially flush with the top surface of the water board.

The method can also include the step 60 of mounting the first speaker, a first electrical conduit, and operably coupling the first speaker to the first electrical conduit. The first electrical conduit can be adapted to be coupled to the audio device. The method also can include the step 62 of forming a housing box adapted to mount a power supply, an amplifying device, an on/off switch, or any combination thereof. The method can also include the step 64 of mounting a power supply and an amplifying device in the housing box substantially flush with one or more surfaces of the water board The disclosure can also include the step 66 of forming a second speaker housing that can receive and mount a second speaker substantially flush with the bottom surface of the water board. The method can also include the step 68 of mounting the second speaker substantially flush with one or more surfaces of the water board. The method can include the step 70 of forming a solar collection device housing adapted to receive and mount a solar collection device substantially flush with the bottom surface of the water board. The method can also include the step 72 of mounting the solar collection device substantially flush with one or more surfaces of the water board. The method step 56 of forming a first speaker housing can further include the step 74 of forming the first speaker housing with at least two sub-speaker housings, where each sub-speaker housing is adapted to mount at least one sub-speaker substantially flush with the top surface of the water board. Furthermore, the method can also include the step 76 of coupling a stabilizing fin to the bottom surface of the water board.

In one embodiment, the method can include, without any particular reference to the Figures, some or all of the following steps: Forming a water board apparatus by forming a water board, forming a first speaker housing, forming a housing box, forming at least one cavity, as appropriate, for mounting or installing a first and second electrical conduit. The first electrical conduit, the second electrical conduit, or both, is can be mounted or installed within the at least one cavity. The method can also include subsequently filling the at least one cavity with a material such as caulk or silicone, and sanding the water board until it is substantially flush, substantially smooth, or both. The method can further include forming a solar collection device housing and forming an area on the bottom surface of the water board for coupling at least one stabilizing fin. The method can further include applying a first coat of fiberglass or carbon fiber with resin, or other suitable material in order to improve the structural integrity of the water board, the waterproofing of the water board, or both. The method can further include applying a second coat of fiberglass or carbon fiber with resin, or other suitable material in order to improve the structural integrity of the water board, the waterproofing of the water board, or both.

The method further can include mounting some or all of the components (for example, a first speaker, a second speaker, a power supply, an amplifying device, an on/off switch, an audio device, a solar collection device, a second speaker, or the like), and painting the water board. The method further includes sanding the surface of the water board, buffing the surface of the water board, or both, until the water board is substantially flush, substantially smooth, or both. The method can further include mounting, installing, or coupling one or more of the following with the water board: a housing box lid, an audio device lid, at least one stabilizing fin, a leash plug, and a traction pad. The method can further include coupling the electrical conduits to each of the remaining components and mounting the components inside their respective housings of the water board. In one embodiment, the one or more components are epoxy mounted in the water board.

The forming steps outlined above can be performed in various ways, such as molding, cutting, drilling, sanding, lathing, or any other method of reshaping, resizing, or reconfiguring a material suitable for building a sports board apparatus. In one embodiment, the housings, the at least one cavity, or both can be formed by drilling or cutting the water board 2 with a router to form housings, cavities, or both, of sufficient volume to mount various components. For example, the first speaker housing 8, the housing box 12, the audio device housing 18, the solar collection device housing 28, and the second speaker housing 30 can vary in depth, or all be of the same depth with respect to each of their respective surfaces of the water board 2.

In one exemplary and non-limiting illustrative embodiment, the audio device housing 18 can reach a depth of at least one and three-quarter inches from the top surface 5 of the water board 2, the solar collection device housing 24 can reach a depth of at least one-half inch from the bottom surface 7 of the water board 2, and the remaining housings can reach a depth of at least one-half inch with respect to each of their respective surfaces of the water board 2. In one embodiment, the housing box 12 can reach a depth of at least two inches from the top surface 5 of the water board 2.

The water board 2 can be made from many different types of material including, wood, fiberglass, plastic, synthetic or semi-synthetic organic amorphous solids, or any other metal, polymers, composite materials, polyurethane, foam, polystyrene foam, or other structural materials. The water board 2 can also be coated in a material such as fiberglass, cloth and polyester, or epoxy resin. In one embodiment, the sports board 2 can be a surfboard; however, other sports boards can be employed as well, such as windsurfing boards, stand-up paddle boards, wakeboards, kneeboards, snowboards, kayaks, or canoes. The sports board apparatus can include a non-water board apparatus. A example of a non-water board apparatus can include a skateboard. Further, an exemplary and non-limiting illustrative example of the audio device 20 can include an mp3 player, such as an iPod® player, a compact disc player, a tape player, or a radio.

The term "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally is forming one functional member with another in a unitary fashion. The coupling can occur in any direction, including rotationally.

The Figures described above and the written description of specific structures and functions above are not presented to limit the scope of what Applicant has invented or the scope of the appended claims. Rather, the Figures and written description are provided to teach any person skilled in the art to make and use the invention for which patent protection is sought. Those skilled in the art will appreciate that not all features of a commercial embodiment of the invention is described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions can include, and likely are not limited to, compliance with system-related, business-related, government-related and other constraints, which can vary by specific implementation, location and from time to time. While a developer's efforts might be complex and time-consuming in an absolute sense, such efforts would be, nevertheless, a routine undertaking for those of skill this art having benefit of this disclosure. It must be understood that the invention disclosed and taught herein is susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Likewise, discussion of singular elements or components can include plural elements or components, and vice-versa.

The order of steps can occur in a variety of sequences unless otherwise specifically limited. The various steps described herein can be combined with other steps, interlineated with the stated steps, and/or split into multiple steps. Similarly, is elements have been described functionally and can be embodied as separate components or can be combined into components having multiple functions. In some alternate implementations, the functions/actions/structures noted in the Figures can occur out of the order noted in the block diagrams and/or operational illustrations. For example, two operations shown as occurring in succession, in fact, can be executed substantially concurrently or the operations can be executed in the reverse order, depending upon the functionality/acts/structure involved. Furthermore, although FIG. 8 illustrates one possible embodiment of a method of making a water board apparatus, several other embodiments have been contemplated as well. For example, although FIG. 8 recites the step 58 of forming an audio device housing before the step 70 of forming a solar collection device housing, other embodiments can include performing step 70 before step 58. In some embodiments, some steps can be omitted altogether. Therefore, though not explicitly illustrated in the Figures, any and all combinations or sub-combinations of the steps illustrated in FIG. 8, or additional steps described in the Figures or the detailed described provided herein, can be performed in any order, with or without regard for performing the other recited steps.

Those of skill in the art should, in light of the present disclosure, appreciate that many changes can be made in the specific embodiments which are disclosed and still obtain a like or similar result without departing from the scope of the invention.

The following examples are included to demonstrate optional embodiments of the invention. It should be appreciated by those of skill in the art that the techniques disclosed in the examples which follow represent techniques discovered by the inventor to function well in the practice of the invention, and thus can be considered to constitute optional modes for its practice. For example, although the first speaker housing 10, the housing box 12, and audio device housing 18 are depicted as residing above the lateral axis 6, these housings can be incorporated into other areas of the water board 2 as well, such as below the lateral axis 6. Likewise, although the second speaker housing 28 and the solar collection device housing 24 are depicted as residing below the lateral axis 6, these housings can be incorporated into other areas of the water board 2 as well, such as above the lateral axis 6. Likewise, devices and housings depicted on particular sides of longitude axis 4 can be incorporated on other areas of the water board 2. Additionally, although water board 2 is depicted as being symmetrical with respect to the longitudinal axis 4 and lateral axis 6, other non-geometrically symmetrical shapes can be employed as well in forming water board 2. Water board 2 can be of uniform thickness, or its thickness can vary in different sections of the water board 2. Additionally, components can be added to water board 2 as well, such as a leash plug adapted to couple a leash to the water board 2. Furthermore, components can be repositioned to other areas of the water board 2, for example the on/off switch 38 can be moved out of the housing box 12 and mounted at a different location on the water board 2.

The invention have been described in the context of optional embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to fully protect all such modifications and improvements that come within the scope or range of equivalent of the following claims.

What is claimed is:

1. A water board apparatus, comprising:

a water board having a top surface and a bottom surface and adapted to traverse a surface of water, snow, or ice, wherein said water board comprises:

a first half and a longitudinally opposite second half;

a first speaker housing adapted to receive a first speaker;

a second speaker housing adapted to receive a second speaker; and an audio device housing adapted to receive an audio device;

wherein said first speaker housing is coupled to the first half and configured to mount the first speaker substantially flush with the top surface of said water board;

wherein said second speaker housing is coupled to the second half and configured to mount the second speaker substantially flush with the bottom surface of said water board;

wherein said audio device housing is configured to mount the audio device substantially flush with the top surface of said water board;

wherein at least one of said first and second speaker housings is coupled to said audio device housing with an electrical conduit structure including one or more wires; and wherein said water board further comprises a solar collection device coupled with a solar collection device housing, wherein said solar collection device is mounted substantially flush with the bottom surface of said water board.

2. The water board apparatus of claim 1, wherein said water board further comprises at least one of a speaker coupled with one of said first and second speaker housings and an audio device coupled with said audio device housing.

3. The water board apparatus of claim 1, wherein said water board further comprises a housing box adapted to mount a power supply, an amplifying device, or a combination thereof substantially flush with the top surface of said water board.

4. The water board apparatus of claim 3, wherein said water board further comprises a housing box lid adapted to be coupled to a portion of said housing box, wherein said housing box lid forms a water-resistant seal with said housing box, and further wherein said housing box lid is substantially flush with the top surface of said water board.

5. The water board apparatus of claim 3, wherein said water board further comprises at least one of an amplifying device and a power supply coupled with said housing box.

6. The water board apparatus of claim 1, wherein at least one of said first and second speaker housings further comprises at least two sub-speaker housings, and wherein each sub-speaker housing is adapted to mount at least one sub-speaker substantially flush with one of the top and bottom surfaces of said water board.

7. The water board apparatus of claim 1, wherein said water board further comprises an audio device housing lid adapted to be coupled to a portion of said audio device housing, wherein said audio device housing lid forms a water-resistant seal with said audio device housing, and further wherein said audio device housing lid is substantially flush with the top surface of said water board.

8. The water board apparatus of claim 1, wherein the first half of said water board is a front half and the second half of said water board is a rear half.

9. The water board apparatus of claim 1, wherein the first half of said water board is a rear half and the second half of said water board is a front half.

10. The water board apparatus of claim 1, further comprising a speaker coupled with the second speaker housing and a first audio device coupled to the speaker, the first audio device and speaker being configured to output an audio signal that deters sharks during use of the water board.

11. The water board apparatus of claim 10, wherein the audio device is coupled with the audio device housing.

12. The water board apparatus of claim 10, further comprising a second audio device configured to output music or other audio through one or more speakers coupled with the first speaker housing.

13. The water board apparatus of claim 10, further comprising wherein the first audio device is configured to operate independently from a second audio device coupled to a speaker mounted in the first speaker housing so that the first audio device can optionally output the audio signal when the second audio device is present and in use.

14. A method of making a water board apparatus, comprising:

forming a water board having a top surface, a bottom surface, a first half and a longitudinally opposite second half, the water board being adapted to traverse a surface of water, snow, or ice;

forming a first speaker housing in the first half of said water board, wherein said first speaker housing is adapted to receive a first speaker;

forming a second speaker housing in the second half of said water board, wherein said second speaker housing is adapted to receive a second speaker;

forming an audio device housing in the top surface of said water board, wherein said audio device housing is adapted to receive an audio device;

disposing the first speaker housing substantially flush with the top surface of the water board;

disposing the second speaker housing substantially flush with the bottom surface of the water board;

disposing an electrical conduit including one or more wires at least partially within the water board;

coupling the electrical conduit between the audio device housing and at least one of the first and second speaker housings; and forming a solar collection device housing in the bottom surface of said water board and coupling a solar collection device with the solar collection device housing so that the solar collection device is substantially flush with the bottom surface of said water board.

15. The method of claim 14, further comprising coupling at least one speaker with one or more of the first and second speaker housings.

16. The method of claim 14, further comprising forming a housing box adapted to mount a power supply, an amplifying device, or a combination thereof substantially flush with the top surface of said water board.

17. The method of claim 14, wherein forming a first speaker housing further comprises forming at least two sub-speaker housings, wherein each sub-speaker housing is adapted to mount at least one sub-speaker substantially flush with the top surface of said water board.

18. A water board apparatus, comprising:

a water board adapted to traverse a surface of water, snow, or ice, the water board having a top surface, a bottom surface, a front half and a longitudinally opposite rear half;

a first speaker housing disposed at least partially within the front half of the board;

a first speaker coupled with the first speaker housing, the first speaker being mounted substantially flush with the top surface of the board;

a second speaker housing disposed at least partially within the rear half of the board;

a second speaker coupled with the second speaker housing, the second speaker being mounted substantially flush with the bottom surface of the board;

an audio device housing disposed at least partially within the board longitudinally between the first and second speaker housings, the audio device housing including a lid that is substantially flush with the top surface of the board when disposed in a closed position;

a first conduit including one or more wires;

wherein the first conduit is coupled between the audio device housing and the first speaker housing and is disposed at least partially within the board; and a solar collection device disposed at least partially within the board longitudinally between the first and second speaker housings, the solar collection device being substantially flush with the bottom surface of the board.

19. The apparatus of claim 18, further comprising a housing box disposed at least partially within the board longitudinally between the first and second speaker housings, the housing box including a lid that is substantially flush with the top surface of the board when disposed in a closed position.

20. The apparatus of claim 18, further comprising a traction pad coupled to the top surface on the rear half of the board, and wherein the second speaker housing is disposed at least partially beneath the traction pad.

* * * * *